US005419709A

United States Patent [19]

Onoda

[11] Patent Number: 5,419,709

[45] Date of Patent: May 30, 1995

[54] SHIELDED CONNECTOR

[75] Inventor: Katsuhiko Onoda, Shizuoka, Japan

[73] Assignee: Yazaki Corporation, Tokyo, Japan

[21] Appl. No.: 168,362

[22] Filed: Dec. 17, 1993

[30] Foreign Application Priority Data

Dec. 18, 1992 [JP] Japan ..... 4-338734

[51] Int. Cl.[6] ..... H01R 4/66

[52] U.S. Cl. ..... 439/95; 439/610

[58] Field of Search ..... 439/95, 610

[56] References Cited

U.S. PATENT DOCUMENTS 5,199,891 4/1993 Reed ..... 439/610 X

FOREIGN PATENT DOCUMENTS 569874 9/1993 Japan ..... H01R 13/648

*Primary Examiner*—Eugene F. Desmond

*Attorney, Agent, or Firm*—Sughrue, Mion, Zinn, Macpeak & Seas

[57] ABSTRACT

A shielded connector is provided in which an electric wire accommodation of the shielded connector is smaller than prior art and the shielded connector is made compact by substantially varying the lengths of connection electric wires connected to a plurality of terminals from short to long stepwise.

2 Claims, 4 Drawing Sheets

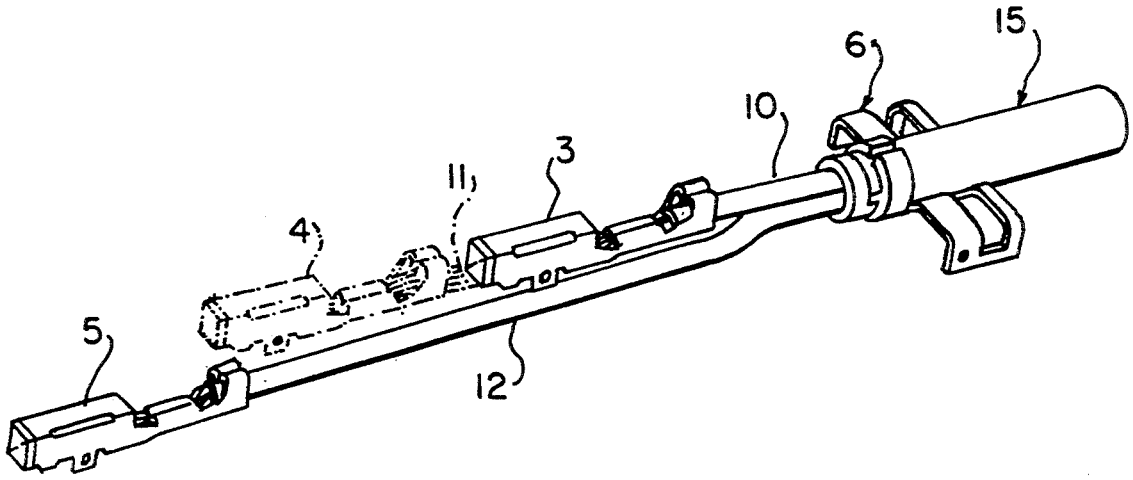
FIG. 3
FIG. 4
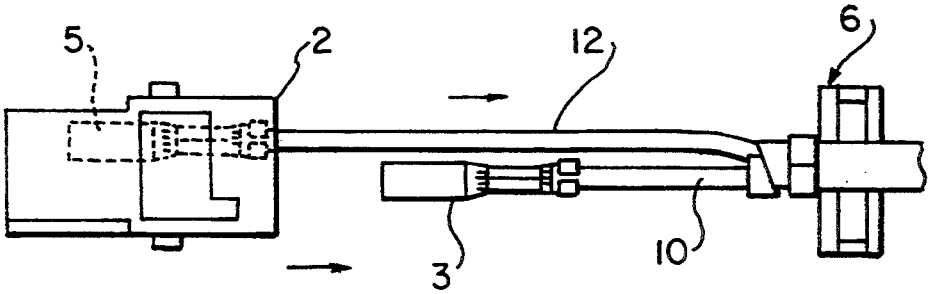

SHIELDED CONNECTOR

FIELD OF THE INVENTION

This invention relates to a shielded connector in which a plurality of electric wires with terminals of a shielded electric wire is accommodated in a connector housing.

BACKGROUND OF THE INVENTION

FIG. 7 shows an exploded perspective view of a prior art shielded connector. A shielded connector 35 consists of an insulating resin connector housing 37 having three terminal accommodation chambers 36, a shielded electric wire 40 with a derived connection electric wires 39 to be connected to female terminals 38 which are inserted into the terminal accommodation chambers 36, a connection member 42 which is solderless-connected to an electric wire derivation base 41 of the shielded electric wire 40, and split shielded cases 47, 48 which have an accommodation 43 of the connector housing 37, an accommodation 44 of the connection electric wires 39 and a retainer 46 of the connection member 42.

The female terminals 38 are inserted into the connector housing 37 and engaged to be held from above by a spacer 49. A mating projection 51 which corresponds to a groove 50 of the accommodation 43 is disposed on the side of the connector housing 37. Two of the three female terminals 38 are connected to the coated connection electric wires 39 and the remaining one is connected to a grounding bare wire $39_1$. The connection electric wires 39 and the grounding bare wire $39_1$ are press-bonded by a pair of clamp pieces 55 of the connection member 42 at the derivation base 41 of the shielded electric wire 40 and press-bonded with a coated section 54 of the shielded electric wire 40 by a press bonding piece 52. The bare wire $39_1$ is connected to the connection member 42 via a braiding (not shown) within the shielded electric wire 40. The connection member 42 has a contact piece 53 sticking out from each side and is held for connection between the top and bottom shielded cases 47, 48.

Respective connection electric wires 39 and the grounding bare wire $39_1$ are accommodated in the accommodation 44 of the shielded case in the state that they are set long and bent taking into account the insertion of the terminals into the connector housing 37. The shielded cases 47, 48 are made by conductive plating of a synthetic resin material and shield the interior electric wires and terminals from noises.

The above prior art shielded connector has drawbacks that the electric wire accommodation 44 within the shielded case 47 becomes long and the connector 35 itself is enlarged because the connection electric wires 39 and the grounding bare wire $39_1$ are set long to make the insertion easier. And, as shown in FIG. 8, which is another prior art shielded connector, when connection electric wires 39' are set short, a space L between the housing 37 and an electric wire derivation base 41' becomes narrow, losing a sufficient space for holding the connection electric wires 39', and it becomes necessary to insert a plurality of terminals 38' at the same time. Thus, there is a disadvantage that it is hard to work.

SUMMARY OF THE INVENTION

An object of this invention is to provide a shielded connector which facilitates insertion of the connection electric wires with terminals into a connector housing and can prevent the connector itself from becoming enlarged.

This invention, in a shielded connector comprising an insulation housing for accommodating a plurality of terminals, a conductive shielded case to accommodate the insulation housing, and a shielded electric wire connected to the conductive shielded case at an electric wire derivation base having a plurality of connection electric wires to be connected to the terminals derived; sets the lengths of the said connection electric wires to vary from short to long stepwise to make an electric wire accommodation of the shielded case smaller than prior art and enable the connector itself to be made compact.

BRIEF DESCRIPTION OF THE DRAWINGS

FIG. 3 is a perspective view showing a shielded electric wire with the terminals connected in one example of the shielded connector of this invention.

FIG. 4 is a plan view showing the inserted state of the terminals in one example of the shielded connector of this invention.

DETAILED DESCRIPTION OF THE INVENTION

In this invention, a shielded connector comprising an insulation housing for accommodating a plurality of terminals, a conductive shielded case to accommodate the insulation housing, and a shielded electric wire connected to the conductive shielded case at an electric wire derivation base having a plurality of connection electric wires to be connected to the terminals derived; the lengths of the connection electric wires are set to vary from short to long stepwise to make an electric wire accommodation of the shielded case smaller than prior art and make the connector itself compact. In addition, the connection electric wires have their thickness varied by degrees as the longest wire has the most thin diameter and the shortest wire has the most thick diameter.

When assembling, the longest connection electric wire with a terminal is inserted for fixing into the extreme side terminal accommodation chamber of the connector housing. Then, the connector housing is moved toward the next longest connection electric wire with a terminal, and the connection electric wire with a terminal is inserted for fixing into the next side chamber to the extreme side chamber with the set longest connection electric wire bent.

In this way, a plurality of connection electric wires are inserted for fixing in order of length into the respective chamber of from the extreme side to the other side in the housing.

Conversely, it is also possible to insert for fixing the shortest connection electric wire into the extreme side chamber of connector housing, then to insert for fixing the next shortest connection electric wire while bending into the next side chamber to the extreme side chamber.

EXAMPLE 1

Figure 1:
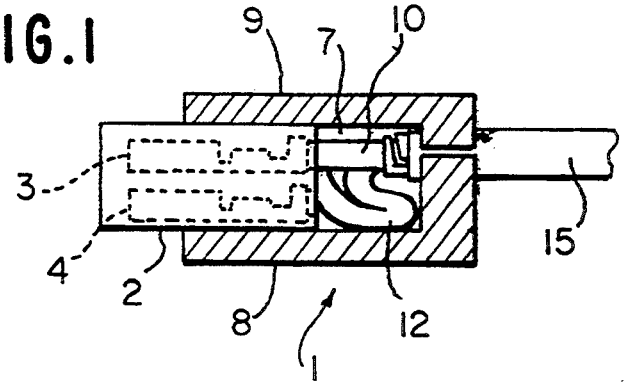
FIG. 1 is a vertical sectional view showing the outline of one example of the shielded connector of this invention.
Figure 2:
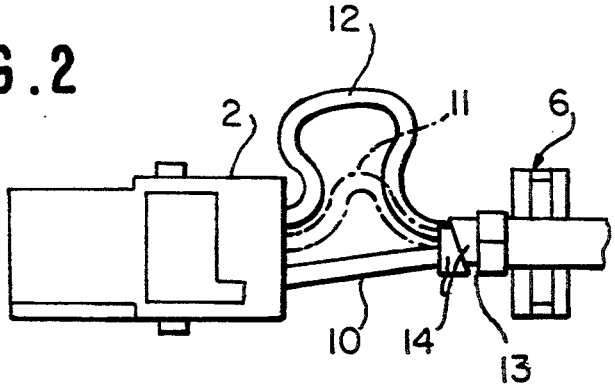
FIG. 2 is a plan view showing a connector housing having the terminals accommodated in one example of the shielded connector of this invention.

FIG. 1 is a vertical sectional view showing one example of the shielded connector of this invention. FIG. 2 is a plan view showing a connector housing having the terminals inserted for fixing. FIG. 3 is a perspective view showing a shielded electric wire with the terminals connected. A shielded connector 1 comprises an insulating resin connector housing 2, a plurality of female terminals 3, 4, and 5, conductive resin shielded cases 8, 9 having a shorter electric wire accommodation chamber 7 than prior art, a shielded electric wire 15 with connection electric wires 10, 11, and 12 set to a stepwise length of from short to long and connected to the female terminals, and a connection member 6.

Figure 7:
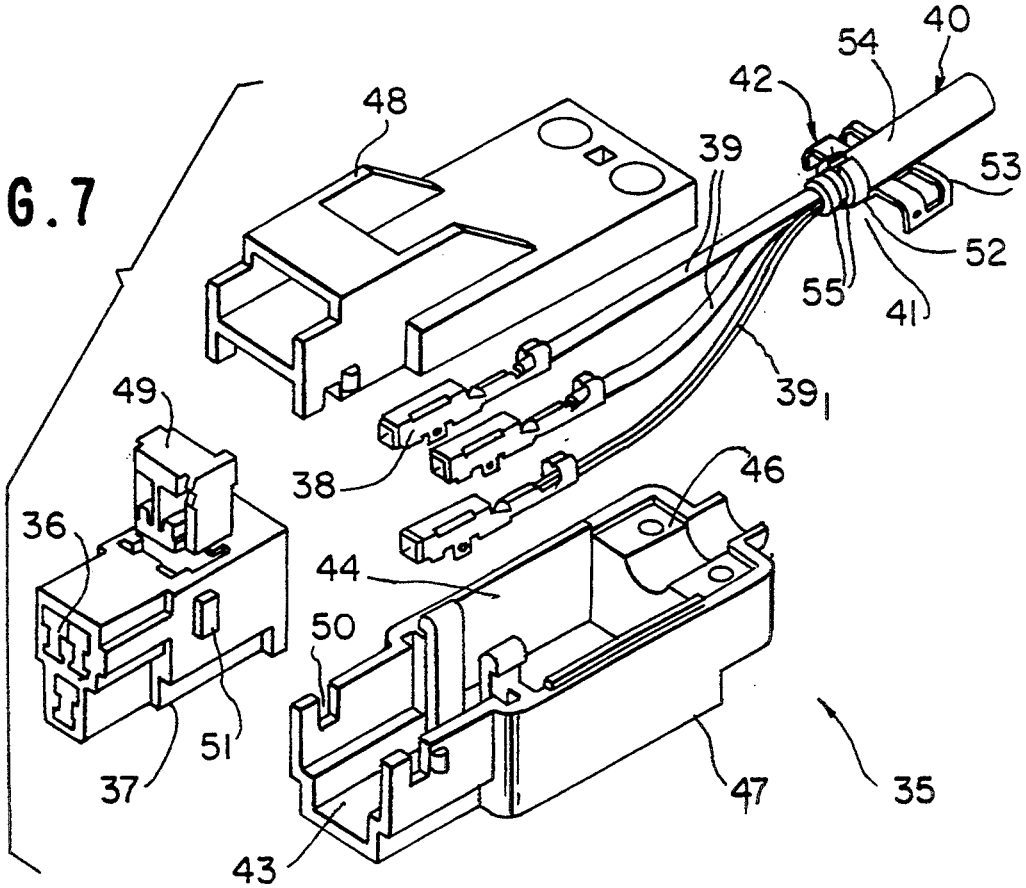
FIG. 7 is an exploded perspective view of a prior art shielded connector.
Figure 8:
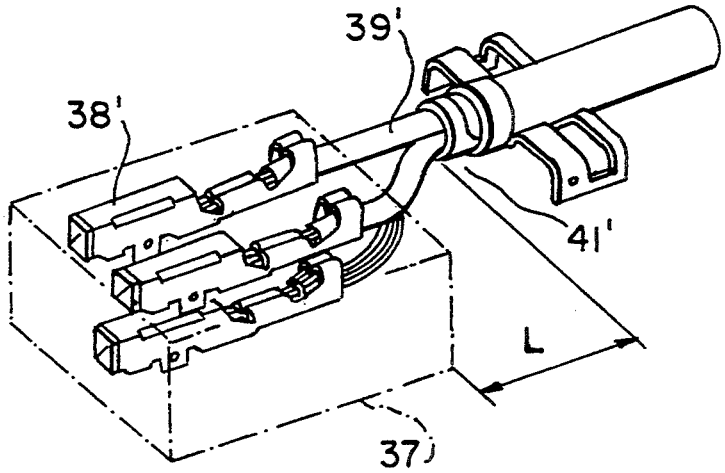
FIG. 8 is a perspective view of a prior art shielded connector.

As to the length of the connection electric wires 10, 11, and 12, the coated wire 10 is set to be the shortest, the grounding bare wire 11 is longer than 10, and the coated wire 12 is the longest. The length of the shortest coated wire 10 is about the same as that of the prior art of FIG. 8 and the length of the longest coated wire 12 is about the same as that of the prior art of FIG. 7.

As shown in FIG. 2, in the state that the connector housing 2 has the terminals 3, 4, and 5 inserted for fixing, the shortest coated wire 10 extends straight, and the longest coated wire 12 is bent in the form of a loop between the connector housing 2 and a clamp piece 14 of the connection member 6 at an electric wire derivation base 13 and the connector housing 2 is accommodated in that state within the electric wire accommodation chamber 7 (FIG. 1) of the shielded case.

As shown in FIG. 4, to insert for fixing the terminals 3, 4, and 5 into the connector housing 2, the terminal 5 of the longest connection electric wire 12 is inserted for fixing in the housing 2, the housing 2 is moved in the direction indicated by the arrow toward the terminal 3 of the short connection electric wire 10, and the terminal 3 of the short connection electric wire 10 is inserted for fixing in the housing 2 with the longest connection electric wire 12 bent.

Figure 5:
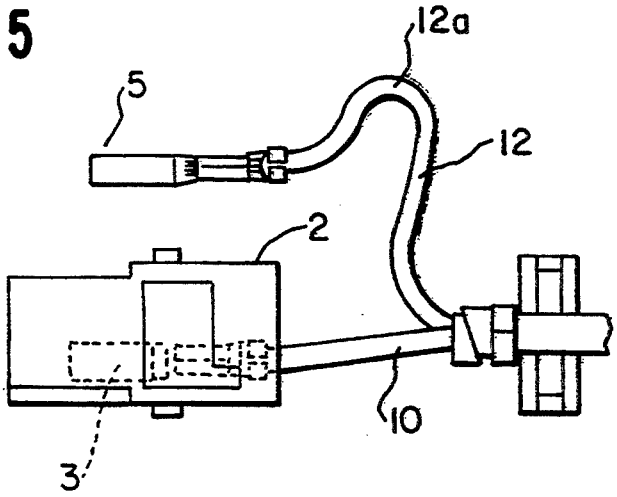
FIG. 5 is a plan view showing the inserted state of the terminals in one example of the shielded connector of this invention.

It is preferable to insert the terminals for fixing by the above procedure but the terminals may be inserted for fixing by following a converse way. In this case, as shown in FIG. 5, the terminal 3 of the shortest connection electric wire 10 is inserted for fixing, then a bent part 12*a* of the long connection electric wire 12 is held to insert for fixing the terminal 5.

EXAMPLE 2

Figure 6:
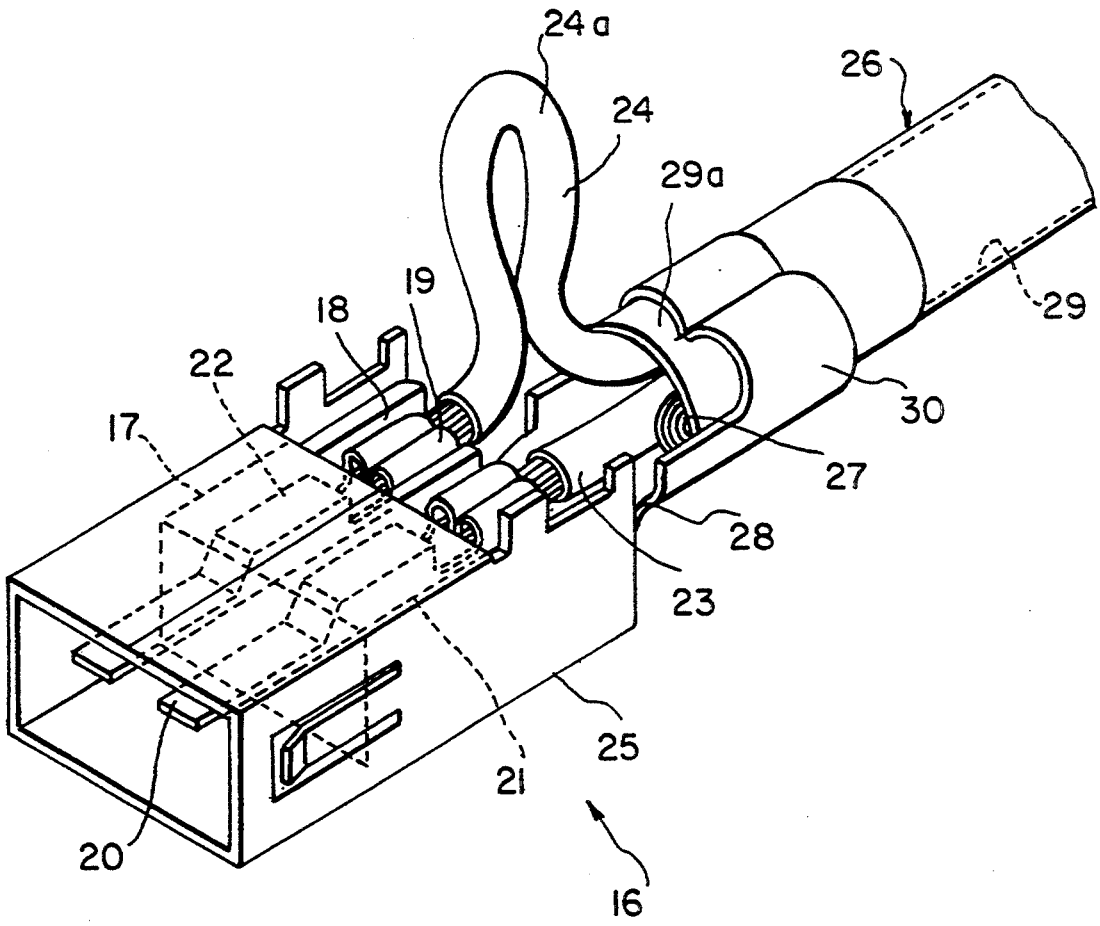
FIG. 6 is a perspective view showing the outline of another example of the shielded connector of this invention.

FIG. 6 shows another example of the shielded connector of this invention. A shielded connector 16 comprises an insulating resin connector housing 17 having an electric wire solderless-connecting part 19 exposed at a top backward opening 18, two female terminals 21, 22 having a leading end tab 20 projected forward from the connector housing 17, a shielded electric wire 26 to be connected to the female terminals 21, 22, and a metal shield 25 to be connected to the outside of the connector housing 17. The female terminals 21, 22 are respectively connected to a short connection electric wire 23 and a long connection electric wire 24, and the terminal 22 is inserted for fixing in the connector housing 17 with the long connection electric wire 24 bent in the form of a loop. Within the shielded electric wire 26, a grounding bare wire 27 is put through, and its leading end is bent at an electric wire derivation base 28 so as to contact with a layered shield 29. The layered shield 29 has a leading end 29*a* bent backward on the surface of the electric wire 26 and press-contacted by a clamp piece 30 which is integral with the metal shield 25. The terminal 22 of the long connection electric wire 24 is inserted for fixing in the connector housing 17 followed by inserting for fixing the terminal 21 of the short connection electric wire 23 in the same way as Example 1.

As described above, the shielded connector of this invention can make the electric wire accommodation smaller than prior art by setting the lengths of a plurality of connection electric wires stepwise with their thicknesses varied by degrees as the longer wire has less thick diameter, so that the connector itself can be made compact and at the same time, the insertion for fixing of the terminals at assembling can be made easily.

What is claimed is:

1. A shielded connector, comprising:

an insulation housing for accommodating a plurality of terminals;

a conductive shielded case to accommodate the insulation housing; and a shielded electric wire connected to the conductive shielded case at an electric wire derivation base having a plurality of connection electric wires to be connected to the terminals, wherein the lengths of the connection electric wires are substantially varied from short to long so that least the longest of said connection electric wires forms a loop when said connection electric wires are accommodated within said insulation housing.

2. The shielded connector according to claim 1, wherein said connection electric wires have their respective thicknesses varied so that the longest wire has the most thin diameter and the shortest wire has the most thick diameter.

* * * * *